United States Patent [19]

Bosshold

[11] 4,081,907

[45] Apr. 4, 1978

[54] LETTER OPENER DEVICE

[76] Inventor: Barry L. Bosshold, 220 Atlantic No. 209, Santa Cruz, Calif. 95062

[21] Appl. No.: 712,585

[22] Filed: Aug. 9, 1976

[51] Int. Cl.[2] ..... B26B 29/00

[52] U.S. Cl. ..... 30/294; 30/DIG. 3

[58] Field of Search ..... 30/289, 294, DIG. 3

[56] References Cited

U.S. PATENT DOCUMENTS

| | | | |
|---|---|---|---|
| 299,398 | 5/1884 | Jones | 30/289 |
| 436,189 | 9/1890 | Prosinger | 30/289 |
| 586,170 | 7/1897 | Fairbairn | 30/289 |
| 802,909 | 10/1905 | Brisacher | 30/294 |
| 1,131,141 | 3/1915 | Kalenborn | 30/294 |
| 1,374,882 | 4/1921 | Curtis | 30/DIG. 3 |
| 3,028,670 | 4/1962 | Tilly | 30/DIG. 3 |
| 3,457,643 | 7/1969 | Hill | 30/294 X |
| 3,673,687 | 7/1972 | Phillips et al. | 30/294 |

FOREIGN PATENT DOCUMENTS

| | | | |
|---|---|---|---|
| 526,755 | 5/1955 | Italy | 30/280 |

*Primary Examiner*—James L. Jones, Jr.
*Assistant Examiner*—J. T. Zatarga
*Attorney, Agent, or Firm*—Melvin R. Stidham

[57] ABSTRACT

A shielded letter opener comprising a finger having a relatively pointed distal end to be inserted under the flap of a sealed envelope and carrying a cutting blade extending upwardly therefrom and facing forwardly. An elongated hood with depending sides extends above and embraces the blade and the finger to protect the user.

6 Claims, 5 Drawing Figures

LETTER OPENER DEVICE

BACKGROUND OF THE INVENTION

Conventional letter openers are configurated in the nature of a knife or dagger to be inserted under the flap of a sealed envelope to sever the flap largely by tearing action. Of course, the blade could be made sharp enough to cut neatly through the flap, but such could present a hazard to the user. Consequently, most letter openers have an edge which is not really sharp enough to cut through the skin.

OBJECTS OF THE INVENTION

It is an object of this invention to provide a letter opener having a sharp blade which is adapted to cut easily through the flap of an envelope.

It is a further object of this invention to provide a letter opener having a sharp cutting blade which is not exposed to handling.

It is a further object of this invention to provide a letter opener with a shielded cutting blade and means to bring said blade into cutting engagement with the flap of a sealed envelope.

Other objects and advantages of this invention will become apparent from the description to follow when read in conjunction with the accompanying drawings.

BRIEF SUMMARY OF THE INVENTION

In carrying out this invention, I provide a letter opener which has a thin finger with a relatively pointed distal end adapted to be inserted under the flap of a sealed envelope. Carried on the finger at a point displaced from the distal end is a sharp razor blade or the like extending upwardly from the finger, whereby it will inherently cut through the flap of an envelope as the finger is moved through and under it. The sides of the finger flare outward rearward of the blade whereby the severed papers will be separated. An elongated shield is carried on the finger to extend generally parallel above and thereto, the shield having depending sides which embrace the finger and blade rather closely, leaving a space too narrow for insertion of a human finger. Complementary depressions and raised portions may be formed on the sides of the finger and the inner sides of the shield, whereby the envelope flap and panel carried on opposite sides of the finger are pulled taut as they are engaged by the blade to facilitate cutting thereof.

DESCRIPTION OF PREFERRED EMBODIMENTS

Figure 1:
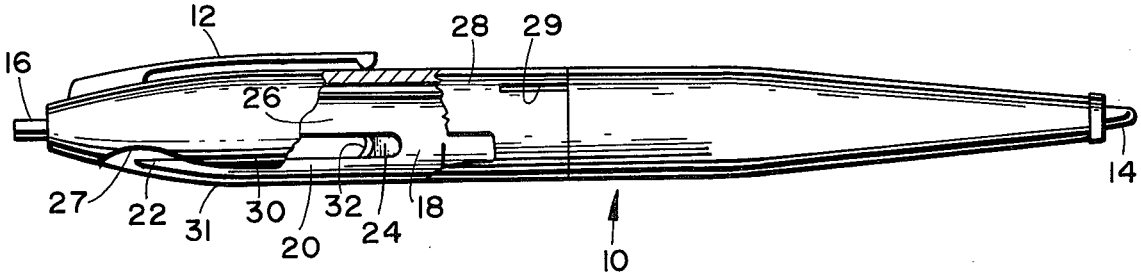
FIG. 1 is an elevation view, partially broken away, of a letter opener embodying features of this invention and carried within a section of a writing pen.
Figure 2:
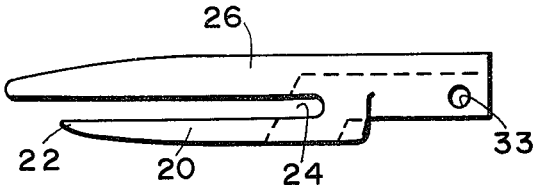
FIG. 2 is an elevation view of the letter opener.
Figure 3:
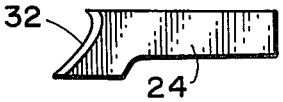
FIG. 3 is an elevation view of a preferred blade embodiment.

The Embodiment of FIGS. 1 to 3

Referring now to FIGS. 1 to 3 with great particularity, there is shown a writing instrument 10, which may be an automatic pencil, a fountain pen, or as shown, a ball point pen, including a pocket clip 12, a ball point 14, and a point actuating button 16. Secured within the cap of the pen is the letter opener 18 comprising a feature of this invention.

The opener includes an elongated finger 20, the distal end of which 22 is pointed enough to enable it to be inserted into the small loop that is formed between a folded paper, e.g. under the flap of a conventional envelope (not shown) to be moved under the flap along the length of the envelope. Carried on the finger to extend upward therefrom is a razor sharp blade 24 which will slice through the top of the flap as the finger moves across the envelope. Preferably, the blade 24 extends completely across the space between the finger and an overlying hood portion 26.

When the letter opener 18 is in place in the cap of the ball point pen 10, the finger 20 is exposed through an opening 27 which is provided in the cap 28 of the pen 10, and extends therealong at least as far back as the cutting blade 24. Hence, the cap 28 forms a shield or hood extension which embraces the blade 24 and finger 20 on both sides, leaving an opening between its depending sides 30 and 31 and the finger 20 which is too small to permit entry of a human finger. Preferably one side 30 is somewhat shorter than the other 31 so that the user can see the point 22 on the finger 20 to insure proper engagement. In the preferred blade configuration shown in FIG. 3, the blade cutting edge extends upwardly, first toward the trailing end of the finger and then forward, so as not to leave an acute angle between blade and hood in which paper particles could be wedged to build up and interfere with the cutting. Any suitable means, such as an adjustment screw 33 may be employed to hold the blade 24 in place on the finger 20. A slot 29 may be provided in the cap 28 to enable the letter opener 18 to be press fit and secured in place therein.

Figure 4:
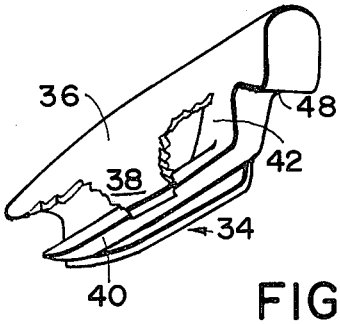
FIG. 4 is a view in perspective of another embodiment of this invention.
Figure 5:
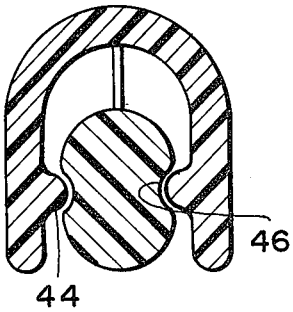
FIG. 5 is a section view of the embodiment of FIG. 4.

The Embodiment of FIGS. 4 and 5

A letter opener 34 of this invention could be provided as a separate, independent tool and, if desired, the hood 36 with depending protective sides 38 and the penetrating finger 40 could be formed, as by molding or casting, as an integral member. In addition, the blade 42 could be formed integrally with the finger and hood or may be a separate member secured by any suitable means (not shown).

If desired, the depending inner sides 38 of the hood and the sides of the finger could be formed with complementary ridges 44 and recesses 46 (FIG. 5) so that the sides 38 of the hood could be squeezed slightly by the operator to pull the envelope panel and flap tightly down over the finger to prevent any yielding or folding of the paper, which might impair the cutting by the blade.

In the embodiment of FIG. 1 the sides of the finger 20 flare outward to form a continuation of the surface of the pen 28 and in FIG. 4 they flare outward at 48 whereby the severed papers will separate smoothly therealong to exit between it and the trailing end of the hood sides 38.

While this invention has been described in conjunction with preferred embodiments thereof, it is obvious that modifications and changes therein may be made by those skilled in the art without departing from the spirit and scope of this invention, as defined by the claims appended hereto.

I claim:

1. A letter opener comprising:

a non-cutting finger having a relatively pointed distal end to be inserted under the flap of a sealed envelope and tapering gradually outward to a wider trailing portion displaced from said distal end;

a sharp cutting blade extending upwardly from said finger at said trailing portion and facing toward said distal end; and an elongated hood joined to and carrying said finger in a junction therewith at said trailing portion and extending forwardly therefrom generally above and parallel to said finger the side surfaces of said junction forming a continuation of the side surfaces of said finger and flaring outward to an increased width rearward of said blade;

depending sides on said hood extending downward to embrace said finger and to restrict access to said blade;

the leading edges of said depending sides occuring adjacent the distal end of said finger while leaving same visually exposed, and the trailing edges of said depending sides occurring forward of the flared sides of said finger and hood junction leaving a space between said trailing edges and said flared sides for withdrawal of a severed envelope therebetween.

2. The letter opener defined by claim 1 including:

complementary raised portions and depressions on the sides of said finger and the inner surfaces of said depending sides.

3. The letter opener defined by claim 1 including:

means releasably securing said blade on said finger.

4. The letter opener defined by claim 1 wherein:

the cutting edge of said blade is configurated to extend upward from said finger and first away from and then toward said distal end.

5. The letter opener defined by claim 1 including:

means mounting same in a section of the body of a writing instrument, extending longitudinally thereof with said hood comprising a portion of said body section.

6. The letter opener defined by claim 1 wherein:

the leading edge of one of the depending sides on said hood occurs intermediate the distal end of said finger and said blade to facilitate placement of an envelope thereon.

* * * * *